US006065853A

United States Patent [19]

Crevier

[11] Patent Number: 6,065,853

[45] Date of Patent: May 23, 2000

[54] DRIVEWAY, WALKWAY AND LANDSCAPE LIGHTING

[76] Inventor: Kirk D. Crevier, 600 Lake Harbor Cir., Orlando, Fla. 32809

[21] Appl. No.: 09/081,736

[22] Filed: May 19, 1998

[51] Int. Cl.[7] ..... F21S 4/00; F21V 31/00; F21W 111/02

[52] U.S. Cl. ..... 362/152; 362/145; 362/153.1; 362/219; 362/223; 362/237; 362/376

[58] Field of Search ..... 362/96, 145, 152, 362/153.1, 153, 219, 267, 146, 147, 151, 234, 235, 236, 237, 376, 377, 378; D26/67

[56] References Cited

U.S. PATENT DOCUMENTS

| | | | |
|---|---|---|---|
| 1,256,232 | 2/1918 | Howard | 362/234 |
| 2,721,255 | 10/1955 | Lanmon | 362/146 |
| 2,920,184 | 1/1960 | Kessler | 362/152 |
| 2,938,110 | 5/1960 | Busch et al. | 240/8.18 |
| 3,131,871 | 5/1964 | Foulds | 362/146 |
| 3,222,509 | 12/1965 | Thedford | 362/267 |
| 3,713,463 | 1/1973 | Bywater, Jr. | 138/89 |
| 3,968,359 | 7/1976 | Shaffer | 240/51.11 R |
| 4,143,411 | 3/1979 | Roberts | 362/145 |
| 4,607,664 | 8/1986 | Carney et al. | 138/89 |
| 4,749,126 | 6/1988 | Kessener et al. | 362/96 |
| 4,857,062 | 8/1989 | Russell | 604/256 |
| 4,945,675 | 8/1990 | Kendrick | 362/92 |
| 4,947,304 | 8/1990 | Payne et al. | 362/267 |
| 5,006,967 | 4/1991 | Diamond | 362/147 |
| 5,113,329 | 5/1992 | Lin | 362/238 |
| 5,160,202 | 11/1992 | Legare | 362/153.1 |
| 5,390,090 | 2/1995 | Nau | 362/153 |
| 5,678,920 | 10/1997 | Kerr | 362/145 |
| 5,683,170 | 11/1997 | Blaha | 362/145 |

FOREIGN PATENT DOCUMENTS

| | | | |
|---|---|---|---|
| 261744 | 5/1968 | Austria | 362/219 |
| 740748 | 8/1966 | Canada | 362/152 |
| 750589 | 5/1933 | France | 362/152 |
| 1408085 | 6/1965 | France | 362/152 |
| 196127 | 2/1908 | Germany | 262/267 |
| 283298 | 3/1931 | Italy | 362/267 |
| 351598 | 8/1937 | Italy | 362/219 |
| 541637 | 12/1941 | United Kingdom | 362/267 |

*Primary Examiner*—Cassandra Spyrou
*Assistant Examiner*—John Juba, Jr.
*Attorney, Agent, or Firm*—Brian S. Steinberger; Law Offices of Brian S. Steinberger

[57] ABSTRACT

A driveway, walkway and landscape lighting assembly. The assembly has an elongated main tube body formed form PVC with hollow parallel support tubes underneath the body for allowing water in the body to seep into the ground. The main body can be up to approximately 30 feet in length. A hollow box with outwardly flared sides sits on top of the main body. A lens cover such as but not limited to a glass brick or plastic brick sits on top of the box. A bulb inside a protected cage can be fished from a remote site down the main elongated body to be positioned under the glass/plastic brick. A 2/1 reducer coupler and a plug can seal the outer open end of the main tube body. A first hose clamp can seal the reducer coupler to the elongated body, and a second hose clamp can seal the other end of the reducer coupler to the plug and lead wires that pass out of the coupler. The coupler allows for changing the bulbs from remote locations(i.e. up to approximately 30 feet away). Alternatively, illuminated fiber optic tubes, flexible clear plastic tubes with inside lights(i.e. miniature holiday lights), fluorescent tubes, and the like can be used. Multiple assemblies can be done in series or parallel to one another.

17 Claims, 2 Drawing Sheets

DRIVEWAY, WALKWAY AND LANDSCAPE LIGHTING

This invention relates to lighting fixtures, and in particular to a chase pipe lighting fixture and bulb assembly for driveway, walkway and landscape lighting.

BACKGROUND AND PRIOR ART

Ground based lighting such as driveway and landscape lighting has become more and more popular over the past several years. Usually, the lights consist of block shaped housings having translucent covers such as Plexiglass, plastic and glass block, that allow light to be emitted therethrough. See for example, U.S. Pat. No. 4,945,675 to Kendrick; U.S. Pat. No. 5,006,967 to Diamond; U.S. Pat. No. 5,160,202 to Legare; U.S. Pat. No. 5,390,090 to Nau; 5,678,920 to Kerr; and U.S. Pat. No. 5,683,170 to Blaha. However, there are many problems with these standard types of ground based lighting sources. For example, each of the ground based light sources have respective bulb sockets fixedly connected behind the translucent covers thus, requiring either the covers themselves to be removed or backplates to be removed whenever a bulb needs to be changed. Thus, if a driveway has a series of ten lights down one side, each of the ten light boxes has to be separately opened to access their respective bulbs. Usually fasteners such as screws at each of these box locations become worn, rusted and otherwise unusable over time, making access to the interior of those boxes difficult to achieve. Furthermore, the removable faceplates and backplates have a tendency to leak thus allowing moisture to seep into the housing and potentially cause the metal electrical components about the bulbs to rust out and short circuit. Still furthermore, because these shells are directly exposed to the elements, it is not uncommon for the covers on the boxes to become rusted and frozen to the other components. Overtime, many driveway and landscaping lights thus become unusable shells that must entirely be replaced. These nuisance and aggravation problems of these traditional ground based light sources expands the longer the driveway and the larger the landscaping area that uses the ground based lighting sources.

SUMMARY OF THE INVENTION

The first objective of the present invention is to provide driveway, walkway and landscape ground based lighting that allows bulbs to be easily replaced from remote locations.

The second object of this invention is to provide a driveway, walkway and landscape ground based lighting having housings that allow water to properly seep out away from the bulbs.

A preferred embodiment of the chase pipe fixture for ground based lighting includes a main elongated hollow cylindrical pipe body having a first open end and a second open end, an opening in a top portion of the body adjacent the second open end, a lens attached to and covering the top portion opening, and a bulb having lead wires that can be inserted through the first open end and fished down so that the bulb is underneath the top portion opening of the body. At least one vertical hollow pipe can be attached to a lower portion of the body for allowing water in the body to seep downward away from the body. A hollow box having outwardly expanding flared sides can be inserted between the top portion opening in the body and the lens. The lens can be a glass brick, and a plastic brick, and the like. A cap can cover the second open end of the body. A removable 2/1 diameter reducing rubber cap can cover the first open end of the body, and a rubber plug can close the open end of the rubber coupler. The assembly and fixture can be used as a single light source and/or as a series of chase pipe fixtures connected to one another.

The invention can be used in new construction and retro-fit construction in either or both residential and commercial applications.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
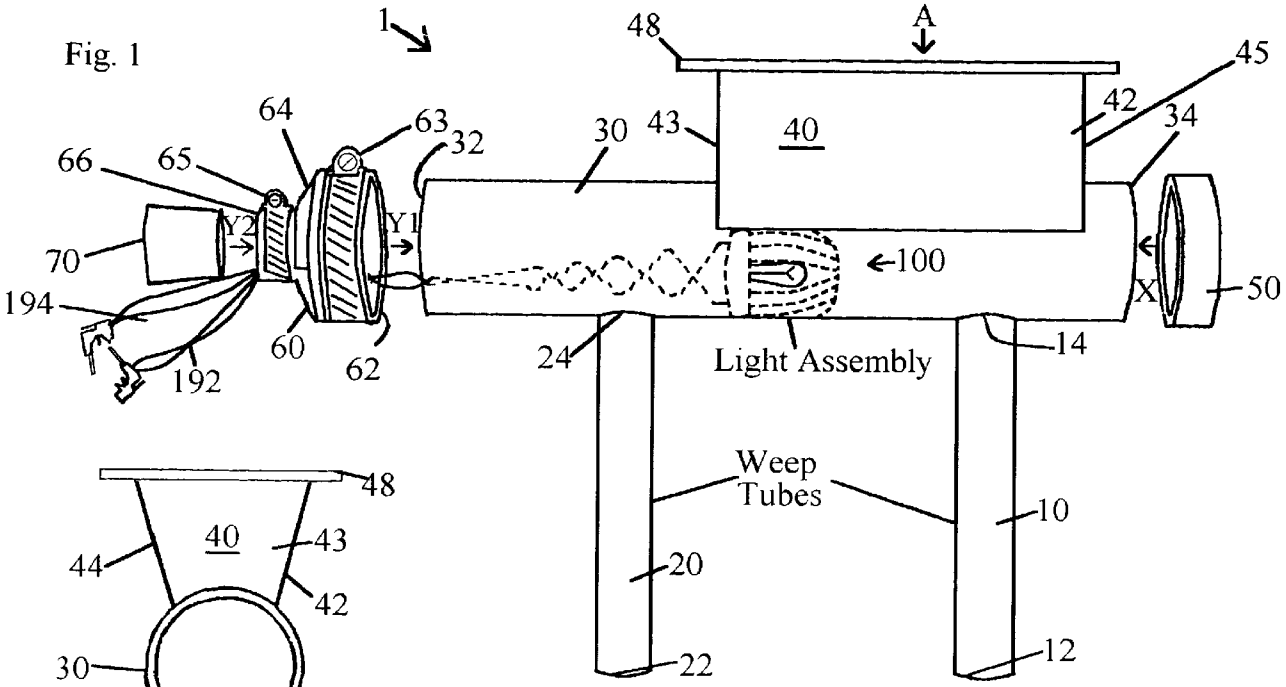
FIG. 1 is a side exploded view of a preferred embodiment of the light assembly invention.
Figure 2:
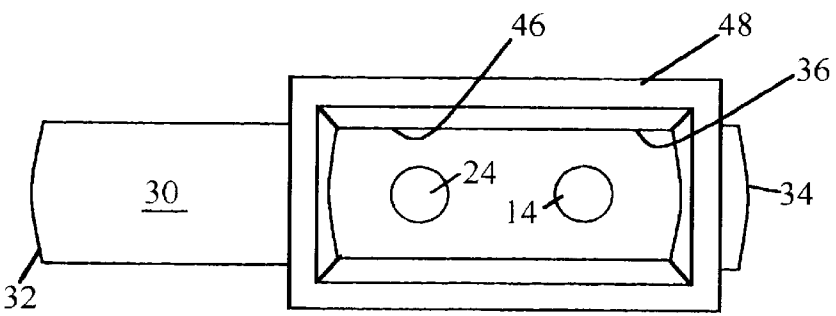
FIG. 2 is a top view of the light assembly invention of FIG. 1 along arrow A.
Figure 3:
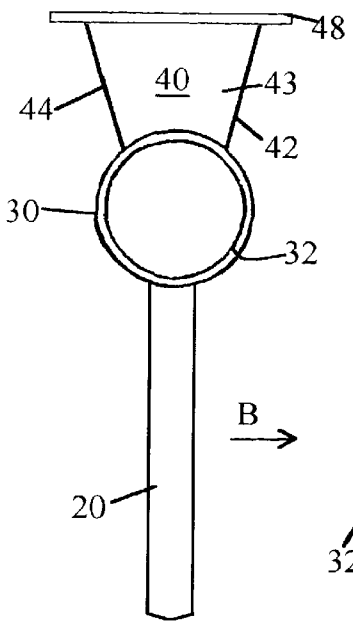
FIG. 3 is a side view of the light assembly invention of FIG. 2 along arrow B.

FIG. 1 is a side exploded view of a preferred embodiment 1 of the light assembly invention. FIG. 2 is a top view of the light assembly invention 1 of FIG. 1 along arrow A. FIG. 3 is a side view of the light assembly invention 1 of FIG. 2 along arrow B. Referring to FIGS. 1–3, light assembly invention includes a main hollow tube housing 30 such as but not limited to 2" PVC, plastic and the like, having opposite open ends 32 and 34. Two parallel hollow tubes 10 and 20, such as but not limited to ½" PVC, plastic and the like, have an open top ends 14, 24, with a through passage to the bottom of main housing 30, so that any moisture, water and the like, in main housing 30 can seep into tubes 10, 20 to the ground below, which will be explained later. On a top portion of main housing 30 is an opening 36, which opens through to the open bottom 46 of a hollow box 40, which can also be formed from materials such as but not limited to PVC, plastic and the like. Box 40 and weep tubes 10, 20 can be attached to main housing 30 by glue, and the like. Hollow box 40 includes two opposite vertical side walls 43, 45 and two outwardly flaring side walls 42, 44, respectively. A lip-rim 48 encircles the upper walls 42–44 of box 40. On one end 34 of main housing 30 can be a slip on cap 50 such as but not limited to a 2" PVC, plastic and the like. On the opposite end 32 of main housing 30 is a removable coupling 60. Coupling 60 can be a 2" by 1" rubber terminating reducer having a large 2" opening 62 which moves in the direction of arrow Y1 wraps about end 32 of main housing 30. A first metal hose clamp 63 with screw head adjuster can tighten end 62 to seal against end main housing end 32. The coupler 60 has an angled portion 64 which reduces to a 1" end 66. Leads 192, 194 from the bulb assembly 100(shown and described in greater detail in reference to FIG. 4) pass through coupler 60, and can be sealed in place by rubber plug 70 that is inserted in the direction of arrow Y2 into end 66, and tightened in place by the second metal hose clamp 65.

Figure 4:
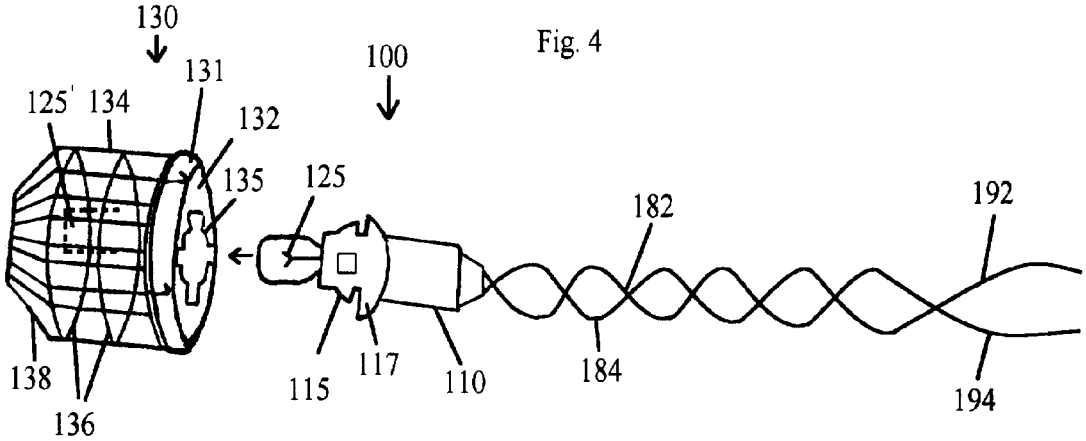
FIG. 4 is an enlarged exploded view of the light bulb socket and shield for use with the light assembly invention of FIGS. 1–3.

FIG. 4 is an enlarged exploded view of the light bulb socket and shield 100 for use with the light assembly invention of FIGS. 1–3. Referring to FIG. 4, socket 110 can be a low wattage source such as those sold in automotive stores, having a base 117, and raised ridge neck 115, beneath bulb 125. The shield 130 includes a plastic rounded lower edge 131, and flat base 132 with opening 135 for allowing the raised ridge neck 115 to pass into and lock thereto. The shield includes a wire cage structure 134 with hoops 136 and angled down front portion 138, which can be made from galvanized wire, and the like. Locking the socket 100 into the base 132 of cage 130 has the bulb 125' centrally supported within the cage 130 and not touching the cage 130 or the main housing 30.

Figure 5:
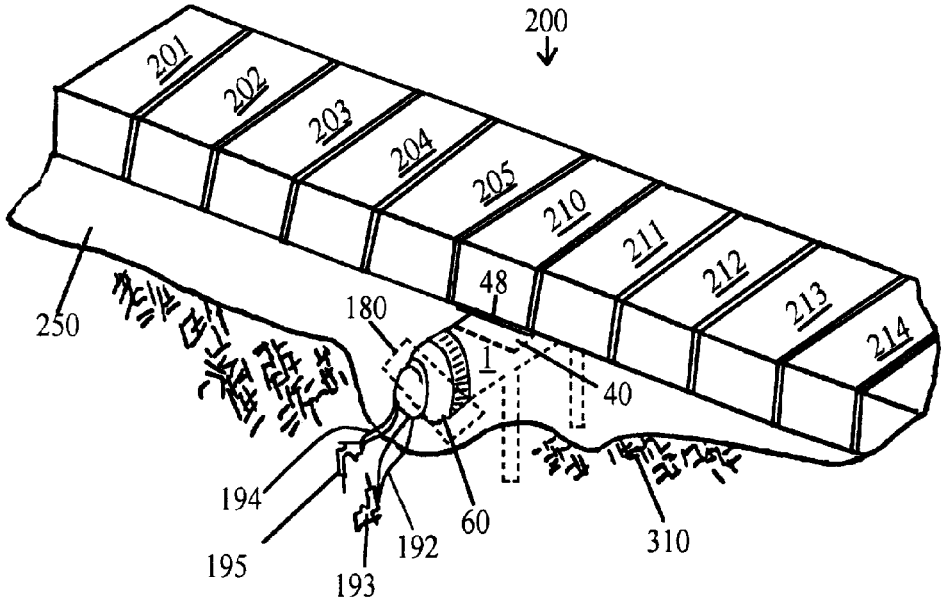
FIG. 5 shows a preferred use of the light assembly invention of FIGS. 1–4 in a driveway/walkway border application.

FIG. 5 shows a preferred use 200 of the light assembly invention of FIGS. 1—4 with clay brick pavers in a driveway border. Referring to FIG. 5, a glass brick 210 can have an undersurface adhered to the lip 48 of box 40 with caulking, glue and the like. Paver bricks 201, 202, 203, 204, 211, 212, 213, 214 can be used side-by-side with glass brick 210. Glass brick 210 and assembly 1 can be spaced at desired intervals of the application. A cement pour 250 can support the paver bricks 201–205, 211–214 with assembly 1 to the ground 310, and mortar supports and locks these paver bricks to one another, where only reducer coupler 60 is exposed. An access hole 180 such as a 6" or 7" irrigation control valve box, can be placed over main housing 30 above end 32 to allow a person to reach reducer coupler 60 in order to change bulb 125.

Referring to FIGS. 1–5, assembly 1 can be inserted by weep tubes 10, 20 into the ground 310, and glass brick 210 can be adhered to the lip 48. The cage 130 and bulb-socket assembly 100 is fished by lead wires 182/192 and 184/194 into opening 32 of main tube housing 30 into the position shown in FIG. 1. Note that main tube housing 30 can have an even longer body so that cage 130 and bulb-socket 100 can be fished from a remote location. The rubber coupler 60 allows for lead wires 182/192, 184/194, to be sealed against rubber plug 70 and inner portion of end 66. The 1" side of coupler 60 can then be tightened with the second hose clamp 65. Ends 193, 195 can be hooked up to a low voltage power supply. A bulb change can be performed by loosening hose clamp 63 and removing the 2" end 62 of the reducer coupler 60 from main housing 30 thus removing light bulb socket and shield 100. After the bulb 125 is replaced, the procedure is reversed and the components are put back in their previous position.

Although the preferred embodiment shows a simple tube housing 30, the invention is applicable where tube housing 30 is up to multiple feet in length(up to approximately 30 feet or more) so that the lead wires 182/192, 184/194 can be fished down the long tube runs. For example, twisting the lead wires together making them more rigid.

Furthermore, extra pipe lines can be connected to either end 32 or end 34 of assembly (FIG. 1) allowing for changing the lighting unit 100 from remote locations. Additionally, the assembly 1 and fixture 100 can be used as a single light source and as a series of chase pipe fixtures connected to one another either parallel to one another or in series to one another.

While the preferred embodiment describes using a glass brick over the assembly, the invention can use other types of light transmitting lens such as but not limited to plastic bricks, lexan type lens, a glass lens, colored covers, opaque covers, and the like.

Although the preferred embodiment describes using a light bulb, other lighting units such as but not limited to illuminated fiber optic tubes, flexible clear plastic tubes with inside lights(i.e. miniature holiday lights), fluorescent tubes, and the like can be used. An end of a lighting tube can connect directly to the open end of the reducing coupler.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A chase pipe fixture for ground based lighting, comprising:

a main hollow body having first open end and a second end;

an opening in a top portion of the body adjacent the second end;

a removable pliable cap for covering the first open end of the body;

a lens attached to and covering the top portion opening; and a lighting unit having lead wires that can be inserted through the first open end and fished therethrough so that the lighting unit is underneath the top portion opening of the body.

2. The chase pipe fixture of claim 1, further comprising:

at least one vertical hollow pipe attached to a lower portion of the body for allowing water in the body to seep downward away from the body.

3. The chase pipe fixture of claim 1, further comprising:

a hollow box having outwardly expanding flared sides between the top portion opening in the body and the lens.

4. The chase pipe fixture of claim 1, wherein the lens includes:

a brick, chosen from at least one of: glass and plastic.

5. The chase pipe fixture of claim 1, wherein the lighting unit includes:

a bulb in a protective shell.

6. The chase pipe fixture of claim 1, further comprising:

a cap for covering the second end of the body.

7. The chase pipe fixture of claim 1, wherein the pliable cap includes:

a diameter reducing coupler.

8. The chase pipe fixture of claim 7, wherein the cap includes;

a pliable plug for closing an open end of a rubber coupler.

9. The chase pipe fixture of claim 1, wherein the main body includes:

a two inch wide pipe.

10. The chase pipe fixture of claim 1, wherein the main body includes:

a PVC pipe.

11. The chase pipe fixture of claim 1, further including:

a series of chase pipe fixtures connected to one another.

12. A chase pipe fixture for ground based lighting, comprising:

a main elongated hollow body having first open end and a second end;

an opening in a top portion of the body adjacent the second end;

a lens attached to and covering the top portion opening;

a lighting unit having lead wires that can be inserted through the first open end and fished therethrough so that the lighting unit is underneath the top portion opening of the body; at least one vertical hollow pipe attached to a lower portion of the body for allowing water in the body to seep downward away from the body; and a hollow box having outwardly expanding flared sides between the top portion opening in the body and the lens, allowing use of the fixture for ground based lighting.

13. The chase pipe fixture of claim 12, further comprising:

a cap for covering the second end of the body.

14. The chase pipe fixture of claim 12, further comprising:

a removable pliable cap for covering the first open end of the body.

15. The chase pipe fixture of claim 14, wherein the pliable cap includes:

a diameter reducing pliable coupler.

16. The chase pipe fixture of claim 15, wherein the pliable cap includes:

a pliable plug for closing an open end of the pliable coupler.

17. A chase pipe fixture for ground based lighting, comprising:

a main hollow body having first open end and a second end;

an opening in a top portion of the body adjacent the second end;

a lens attached to and covering the top portion opening; and a lighting unit including a bulb in a protective shell, the lighting unit having lead wires that can be inserted through the first open end and fished therethrough so that the lighting unit is underneath the top portion opening of the body.

* * * * *